United States Patent [19]

Kroll

[11] 4,357,103

[45] Nov. 2, 1982

[54] ELECTROGRAPHIC APPARATUS AND METHOD FEATURING COMPRESSED-FIELD, MAGNETIC BRUSH DEVELOPMENT

[75] Inventor: Arthur S. Kroll, Spencerport, N.Y.

[73] Assignee: Eastman Kodak Company, Rochester, N.Y.

[21] Appl. No.: 247,977

[22] Filed: Mar. 27, 1981

[51] Int. Cl.[3] ..... G03G 15/00

[52] U.S. Cl. ..... 355/3 DD; 355/14 D; 118/657; 118/658; 430/122

[58] Field of Search ..... 355/3 DD, 14 D, 3 R, 355/14 R; 118/621, 623, 657, 658; 430/31, 39, 122

[56] References Cited

U.S. PATENT DOCUMENTS

| | | | |
|---|---|---|---|
| T959,003 | 6/1977 | Hull | 355/3 DD X |
| 3,648,656 | 3/1972 | Ogawa | 118/637 |
| 3,879,737 | 4/1975 | Lunde | 355/3 DD X |
| 3,892,672 | 7/1975 | Gawron | 355/3 DD X |

*Primary Examiner*—A. C. Prescott

*Attorney, Agent, or Firm*—John D. Husser

[57] ABSTRACT

An improved magnetic brush development device features magnetic counterpoise means located in opposing relation (across the development zone) with the primary magnetic brush field adjacent the development zone. The magnetic counterpoise means has a repelling polarity relative to the primary magnetic brush field and cooperates to form a compressed, smooth nap at the development zone.

11 Claims, 5 Drawing Figures

ELECTROGRAPHIC APPARATUS AND METHOD FEATURING COMPRESSED-FIELD, MAGNETIC BRUSH DEVELOPMENT

BACKGROUND OF THE INVENTION

1. Field of the Invention

The present invention relates to image development devices in electrographic apparatus and more specifically to improved magnetic brush development configurations for such apparatus.

2. Description of the Prior Art

In electrographic apparatus of the kind in which an electrostatic latent image is formed on an image member (e.g. by exposure of a charged photoconductor member or stylus recording on a dielectric member), magnetic brush development is an extremely popular mode of developing the latent image (i.e. applying toner to render the latent image visible). Accordingly, a very large number of structural approaches have been devised to effect magnetic brush development.

Perhaps the most common general approach for magnetic brush development is to provide a non-magnetic cylinder which rotates to transport a developer mixture, comprising magnetic carrier particles bearing triboelectrically-attracted toner particles, from a supply to a development zone adjacent the image member. Stationary permanent magnets inside the cylinder attract the carrier particles to the outer surface cylinder so the carrier and toner will be transported by the rotating cylinder. In another similar mode, the outer cylinder is stationary and the interior magnets rotate to "walk" the developer along the cylinder surface from the supply to the development zone. Other variations provide movement of both the outer cylinder and the magnets or in some instances eliminate the outer cylinder and simply rotate a cylindrical magnet array.

The external magnetic fields, extending from poles of the magnet element of the magnetic brush, tend to form chains of carrier particles, which extend like many small fingers pointing outwardly from the brush. When these fingers move across the electrostatic-image-bearing surface of the member to be developed, toner is attracted from the carrier particles to the image member.

In general, the above-described magnetic brush techniques perform admirably; however, several problems have been encountered. For example, the fingers of developer which form the "nap" of the magnetic brush vary in length and thickness, e.g., because of non-uniformity in the magnet's composition (and thus field strength) or non-uniformity in the carrier particles' size or composition. This nap non-uniformity, in turn, causes uneven development of the contacted electrostatic image. Additionally, the upstanding carrier-chain fingers often scratch the developed image and the image member.

Because of this problem various approaches have been devised to "soften" the nap of magnetic brushes. For example, U.S. Pat. No. 3,457,900 discloses a magnetic brush configuration intended to cause a developer rollback, and consequent tumbling of developer, in the development zone. Another approach described in *Research Disclosure* No. 18319, pp. 357–358, January 1979 published by Industrial Opportunities, Ltd., Homewell, Havant, Hampshire, P09 1EF, United Kingdom, provides an A.C. magnetic field which agitates the nap of the magnetic brush at the development zone. Various prior art devices suggest other means to agitate such fingers of magnetic brush naps. These approaches are successful insofar as they have enhanced the uniformity of image development; however, these solutions give rise to at least one other problem. Specifically, these techniques can increase the likelihood and degree of developer "throw-off" from the magnetic brush. That is, as the developer chains are agitated, the centrifugal force acting on the developer due to the rotational velocity of the magnetic brush can overcome the magnetic attraction, and the carrier is thrown into the area around the development zone. Containment of these dustlike particles is difficult, and their abrasive nature present problems for long-life electrographic apparatus. The problems are even more severe where multicolor development is performed because inter-development-station contamination can occur.

SUMMARY OF THE INVENTION

It is one significant aspect of the present invention to provide structural and functional approach to magnetic brush development which achieves good image uniformity with a reduced throw-off of developer. Another advantage of the present invention is that enhanced, developed-image density can be achieved with its approach. In another aspect, the present invention facilitates electrographic development stations wherein a single magnetic brush accomplishes results previously attainable only with multiple magnetic brushes.

In one aspect, the above advantages are provided for electrographic apparatus, of the kind having a development station and means for moving an image member along an operative path which includes a development zone within the development station, by an improved magnetic brush device. In one preferred embodiment this improved device comprises (1) developer transport means, located at said development station, for moving successive quantities of magnetic developer along a transport path extending to, adjacent and past the development zone and including primary magnet means which form a magnet field of predetermined magnetic polarity pattern which is operative upon developer transported adjacent said development zone and (2) magnetic counterpoise means, located in opposing relation across the development zone from said primary magnet means, for forming a magnetic field having a magnetic polarity pattern which is repelling to said predetermined polarity pattern. In a particularly preferred embodiment, the primary and counterpoise magnetic means are constructed and located to maintain a region of relatively low magnetic field along the image member's path through the development zone.

In a related aspect the present invention provides a method for electrographic development of an electrostatic image bearing member, moving through a development zone. The method comprises transporting magnetic developer, in the influence of a primary magnetic field pattern, along a path extending to, adjacent and past the development zone and compressing the primary magnetic field pattern adjacent the development zone with an opposing magnetic field pattern of repelling magnetic polarity.

BRIEF DESCRIPTION OF THE DRAWINGS

The subsequent description of preferred embodiments is made with reference to the attached drawings in which.

DETAILED DESCRIPTION OF THE PREFERRED EMBODIMENTS

Figure 1:
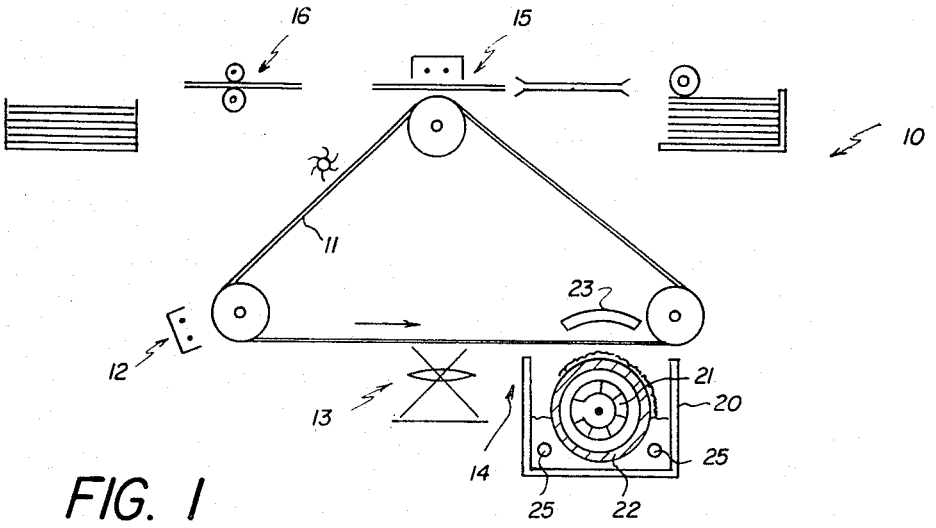
FIG. 1 illustrates, schematically, electrographic apparatus incorporating one embodiment of the present invention.

FIG. 1 illustrates an electrophotographic imaging apparatus which is exemplary of one particularly useful application for the present invention. Those skilled in the art will readily understand that the present invention has similar utility in other electrographic apparatus, e.g. apparatus where electrostatic image patterns are formed on a dielectric image member by stylus recording.

The transfer electrophotographic apparatus 10 of FIG. 1 comprises a photoconductor 11 (typically comprising a photoconductive insulator layer overlying a conductive layer on a support) which is moved around an endless path past the various electrophotographic process stations of the apparatus. Image sectors of the photoconductor 11 are sequentially subjected to a uniform primary charge at corona charging station 12 and then imagewise exposed to a light pattern at exposure station 13 to form an electrostatic latent image. The latent-image-bearing photoconductor sections then move past development station 14 where toner is applied to render the latent image visible. Subsequently the toner image is transferred to a copy sheet at transfer station 15, and the transferred toner is fused to the copy sheet at fixing station 16. In non-transfer electrophotographic apparatus, copy sheets coated with a photoconductor (e.g. zinc oxide) would be fed along the operative path and processed as described to form a toner image, which would be fixed directly on the copy sheet. That is, the transfer station would be omitted.

Figure 2:
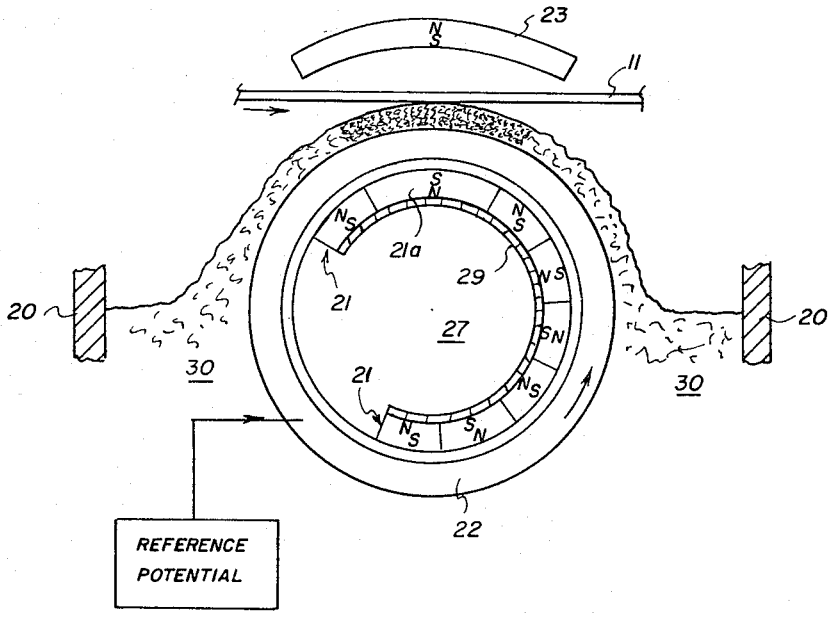
FIG. 2 is an enlarged cross-sectional diagram of portions of the development device shown in FIG. 1.

Referring now to FIG. 2, as well as FIG. 1, one embodiment of improved development device in accordance with the present invention is illustrated. The development station 14 in general comprises a developer reservoir 20, a stationary magnet array for attracting developer for transport from the reservoir to, adjacent and past the development zone, a rotatable shell 22 for so transporting developer attracted by magnet array 21. In accordance with this embodiment of the present invention, counterpoise magnet 23 is located in opposing relation (across the operative path of photoconductor 11) with respect to the portion of magnet array 21 which is adjacent the development zone of photoconductor 11.

More specifically, the developer reservoir is adapted to contain a supply of magnetic developer 30, which can comprise e.g. a mixture of polymeric toner particles and iron carrier particles or a single component developer comprising magnetic toner particles. Usually stirring paddles 25 are provided in the reservoir to mix and triboelectrically charge a toner carrier mixture. Shell 22 preferably is formed of non-magnetic material, e.g. aluminum, and is supported within the reservoir 20 at its ends for rotation around the stationary magnet array 21. The magnet array 21 comprises a plurality of strip magnets which can be supported on a stationary core 27 within cylinder 22. The strip magnets are arranged with their poles as shown in FIG. 2 and extends lengthwise (normal to the plane of FIG. 2) for a distance generally equivalent to the width of the image member to be developed. A magnetic pole coupling piece 29 formed, e.g., of soft steel is provided around the inner periphery of magnet array 21. The strip magnets are permanent magnets formed, e.g., of rubber-bonded barium ferrite.

In FIG. 2 it can be seen that a single strip magnet **21*a* extends substantially the entire length of the portion of the developer transport path adjacent the development zone for photoconductor 11. An alternative construction in accordance with the present invention is to provide a plurality of strip magnets with their poles oriented in a common direction through the region of array 21 that is adjacent the development zone. FIG. 2 also illustrates that counterpoise magnet 23 is oriented so that its pole facing the development zone is the same magnetic polarity (i.e. "S") as the pole of magnet 21*a* which faces the development zone. That is, it is an important feature of the present invention that the primary magnet means 21*a* and counterpoise magnet means 23 be oriented with "same" magnetic poles facing, in a repelling relation. It is preferred in accordance with the present invention that the primary and counterpoise magnet means which oppose each other across the development zone have relative geometry, strength and location so that the magnetic field along the development zone (i.e. the zone of photoconductor and developer contact through the development station) be approximately zero. In the preferred embodiment shown in FIG. 2, the magnet means 21*a* and 23 are formed as concentric sectors spaced along a radius from the center of rotation for shell 22**.

The effect achieved by the magnetic brush configuration just described is illustrated schematically in FIG. 2. There it can be seen that the developer transported toward the development zone forms a loose, uneven nap, being influenced by the magnetic field of alternating N and S magnetic poles of array 21. Note, however, that upon encountering the influence of opposing magnet means **21*a* and 23** the developer compresses and exhibits a more smooth and uniform nap.

Figure 3A:
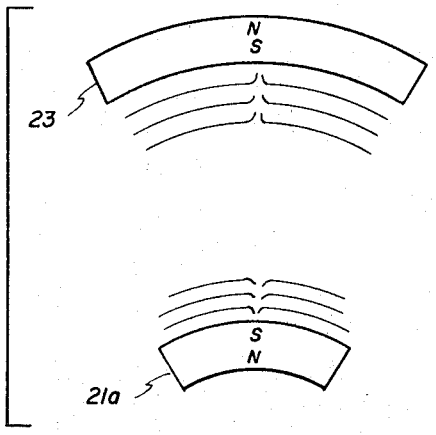
FIG. 3*a* is a schematic diagram illustrating magnetic field patterns of the FIG. 2 device.
Figure 3B:
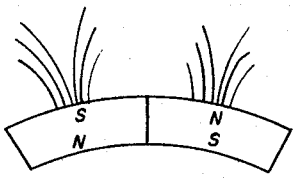
PRIOR ART FIG. 3b
FIG. 3*b* is a schematic diagram similar to FIG. 3*a* but illustrating a magnetic field pattern of a prior art device.

The operative mechanism which is believed to result in this nap-transformation is illustrated schematically in FIG. 3*a*. Thus, the opposing, same-magnetic polarity (repelling) poles of the magnets **21*a* and 23** cause the magnetic field lines of each magnet into a tight alignment with the surface of their respective magnet. This is in contrast to prior art devices such as shown in FIG. 3*b* which have magnetic fields extending more normal to the magnet surface, giving rise to the uneven developer fingers discussed above. It is believed that the magnet arrangement in accord with the present invention causes a magnetic field for magnet **21*a*** shown in FIG. 3*a* and that this correspondingly causes a compressed, smooth and even alignment of developer. Regardless of the physical mechanism causing the effect, the results of magnetic brush configurations are highly advantageous.

First, highly uniform development with reduced image scratching is obtained. Second, developer throw-off is significantly reduced. Additionally it has been noted that this configuration facilitates increased density of developed images. In regard to this last aspect, it is believed the compressed nap formed in accordance with the present invention may affect the nap conductivity, resulting in density enhancement.

Figure 4:
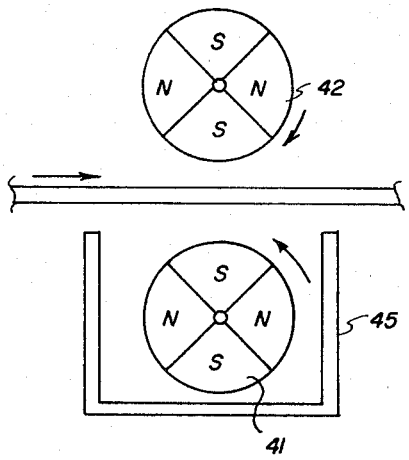
FIG. 4 is a schematic illustration of another embodiment of the development device in accordance with the present invention.

An alternative embodiment of the present invention is shown in FIG. 4. There magnetic brush development device 40 comprises a rotating magnet assembly 41, disposed in reservoir 45 and having alternate north and south poles of peripheral arcuate dimensions generally corresponding to the development zone length and width. It will be appreciated that a concentric shell like that shown and described with respect to FIG. 1 can be provided, either stationary or rotating. In the FIG. 4 embodiment, counterpoise magnet 42 is formed as a magnetically and geometrically identical rotating magnet assembly. The rotation of counterpoise magnet array 42 is synchronized with the rotational development rate of development magnet array 41 so that opposing fields of repelling polarity exist in the development zone at all times. Thus a similar field pattern to that shown in FIG. 3*a* will result with the commensurate tight and smooth nap for developer transported adjacent the development zone.

The invention has been described in detail with particular reference to certain preferred embodiments thereof, but it will be understood that variations and modifications can be effected within the spirit and scope of the invention.

What is claimed is:

1. In electrographic apparatus of the kind including a development station and means for moving an image member along an operative path which includes a development zone within said development station, an improved magnetic brush development device comprising:

(a) developer transport means, located at said development station, for moving successive quantities of magnetic developer along a transport path extending to, adjacent and past said development zone, said transport means having primary magnet means for forming a magnetic field of predetermined magnetic polarity pattern which is operative upon developer transported adjacent said development zone; and (b) magnetic counterpoise means, located across said operative path in opposing relation with said primary magnet means, for forming a magnetic field having a magnetic polarity pattern which is repelling to said predetermined polarity pattern.

2. The invention defined in claim 1 wherein said primary magnet means and said magnetic counterpoise means are constructed and located so that a region of relatively low magnetic field, compared to the magnetic field along said transport path, exists along said operative path of said image member.

3. The invention defined in claim 1 wherein said primary magnet means and said magnetic counterpoise means are disposed in stationary opposing relation and have repelling magnetic fields of a single polarity substantially throughout said development zone.

4. The invention defined in claim 1 wherein said primary magnet means and said magnetic counterpoise means are formed as symmetric multipole-magnet cylinders and are adapted for synchronous rotation so that their opposing pole portions at said development zone are of the same magnetic polarity.

5. The invention defined in claim 1 wherein the magnetic field patterns of said primary magnet means and said counterpoise magnet means are symmetric and of generally equal strength.

6. In electrographic apparatus of the kind in which an image member is movable along an operative path including a development zone and having magnetic brush means located proximate said development zone for moving successive quantities of developer into development relation with such image member at said development zone, the improvement wherein said magnetic brush means comprises primary magnet means for providing a magnetic field of a first polarity adjacent said development zone and counterpoise magnet means, located on the opposite side of said development zone from said primary magnet means for providing a magnetic field of said first polarity adjacent said development zone.

7. The invention defined in claim 6 wherein said primary and counterpoise magnet means have relative field strengths and locations such that the magnetic field along said development zone is approximately zero.

8. The invention defined in claim 6 wherein said primary and counterpoise magnet means are constructed as sections of substantially concentric circles and located at radially spaced locations with respect to the center of said magnetic brush means.

9. A method of developing an electrostatic image on an image member which is moving through a development zone, said method comprising:

(a) transporting magnetic developer, in the influence of a primary magnetic field pattern, along a path extending to, adjacent and past the development zone; and (b) compressing the primary magnetic field pattern adjacent said development zone with an opposing magnetic field pattern of repelling magnetic polarity.

10. The method defined in claim 9 further including the step of balancing the primary and opposing magnetic field patterns so that the magnetic field within said development zone is approximately zero.

11. An improved magnetic brush development device for use in electrophotographic apparatus of the kind including a development station and means for moving an image member along an operative path which includes a development zone within said development station, said device comprising:

(a) developer transport means, located at said development station, for moving successive quantities of magnetic developer along a transport path extending to, adjacent and past said development zone, said transport means having primary magnet means for forming a magnetic field of predetermined magnetic polarity pattern which is operative upon developer transported adjacent said development zone; and (b) magnetic counterpoise means, located across said operative path in opposing relation with said primary magnet means, for forming a magnetic field having a magnetic polarity pattern which is repelling to said predetermined polarity pattern.

* * * * *